US008851835B2

(12) United States Patent
Merritt et al.

(10) Patent No.: US 8,851,835 B2
(45) Date of Patent: Oct. 7, 2014

(54) AIR CYCLE MACHINE COMPRESSOR DIFFUSER

(75) Inventors: Brent J. Merritt, Southwick, MA (US); Harold W. Hipsky, Willington, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 821 days.

(21) Appl. No.: 12/974,410

(22) Filed: Dec. 21, 2010

(65) Prior Publication Data

US 2012/0156027 A1 Jun. 21, 2012

(51) Int. Cl.
*F04D 29/44* (2006.01)

(52) U.S. Cl.
CPC ..... *F04D 29/441* (2013.01); *F04D 29/444* (2013.01)
USPC ..... 415/211.2

(58) Field of Classification Search
USPC ..... 415/208.3, 208.2, 211.2, 224.5, 226
See application file for complete search history.

(56) References Cited

U.S. PATENT DOCUMENTS

| | | | | |
|---|---|---|---|---|
| 2,916,890 | A | 12/1959 | Stein | |
| 3,860,360 | A * | 1/1975 | Yu | 415/208.3 |
| 4,302,150 | A | 11/1981 | Wieland | |
| 4,580,406 | A | 4/1986 | Nims | |
| 5,133,194 | A | 7/1992 | Army, Jr. et al. | |
| 5,387,081 | A | 2/1995 | LeBlanc | |
| 5,529,457 | A * | 6/1996 | Terasaki et al. | 415/208.3 |
| 6,168,375 | B1 * | 1/2001 | LaRue et al. | 415/146 |
| 7,322,202 | B2 | 1/2008 | Zywiak et al. | |
| 7,779,644 | B2 | 8/2010 | Decrisantis et al. | |
| 8,596,968 | B2 * | 12/2013 | Emmerson | 415/208.3 |
| 2005/0217096 | A1 * | 10/2005 | Chan et al. | 29/235 |
| 2007/0134105 | A1 | 6/2007 | Beers et al. | |
| 2008/0019842 | A1 | 1/2008 | Coates et al. | |
| 2012/0114463 | A1 * | 5/2012 | Beers et al. | 415/151 |

FOREIGN PATENT DOCUMENTS

| | | |
|---|---|---|
| CN | 1059959 | 4/1992 |
| CN | 1061264 | 5/1992 |
| EP | 2602191 A1 | 6/2013 |

* cited by examiner

*Primary Examiner* — Ninh H Nguyen
(74) *Attorney, Agent, or Firm* — Carlson, Gaskey & Olds, P.C.

(57) ABSTRACT

A diffuser for an air cycle machine defines airflow both to a compressor rotor from the inlet and from the compressor rotor through a plurality of vanes that define radially extending airflow passages. The size and shape of both the inlet and the vanes of the diffuser define and tailor the character of airflow presented to and leaving the compressor rotor to provide a desired change in air flow.

17 Claims, 5 Drawing Sheets

AIR CYCLE MACHINE COMPRESSOR DIFFUSER

BACKGROUND

This disclosure generally relates to a compressor diffuser for an air cycle machine. An air cycle machine may include a centrifugal compressor and a centrifugal turbine mounted for co-rotation on a shaft. The centrifugal compressor further compresses partially compressed air, such as bleed air received from a compressor of a gas turbine engine. The compressed air discharges through a diffuser to a downstream heat exchanger or other device before returning to the centrifugal turbine. The compressed air expands in the turbine to thereby drive the compressor. The air output from the turbine may be utilized as an air supply for a vehicle, such as the cabin of an aircraft.

SUMMARY

An example disclosed air cycle machine ("ACM") includes a diffuser for radially directing airflow exiting the compressor rotor. The example diffuser includes a diffuser portion that is substantially disk shaped that extends radially about the compressor rotor and a hub portion that defines an inlet for incoming airflow to the compressor rotor. The hub portion and the diffuser portion are a single unitary part with a continuous inner surface that defines a portion of the air flow path entering the compressor rotor flowing through the compressor rotor and exiting the compressor rotor through a plurality of radially extending vanes.

These and other features disclosed herein can be best understood from the following specification and drawings, the following of which is a brief description.

DETAILED DESCRIPTION

Figure 1:
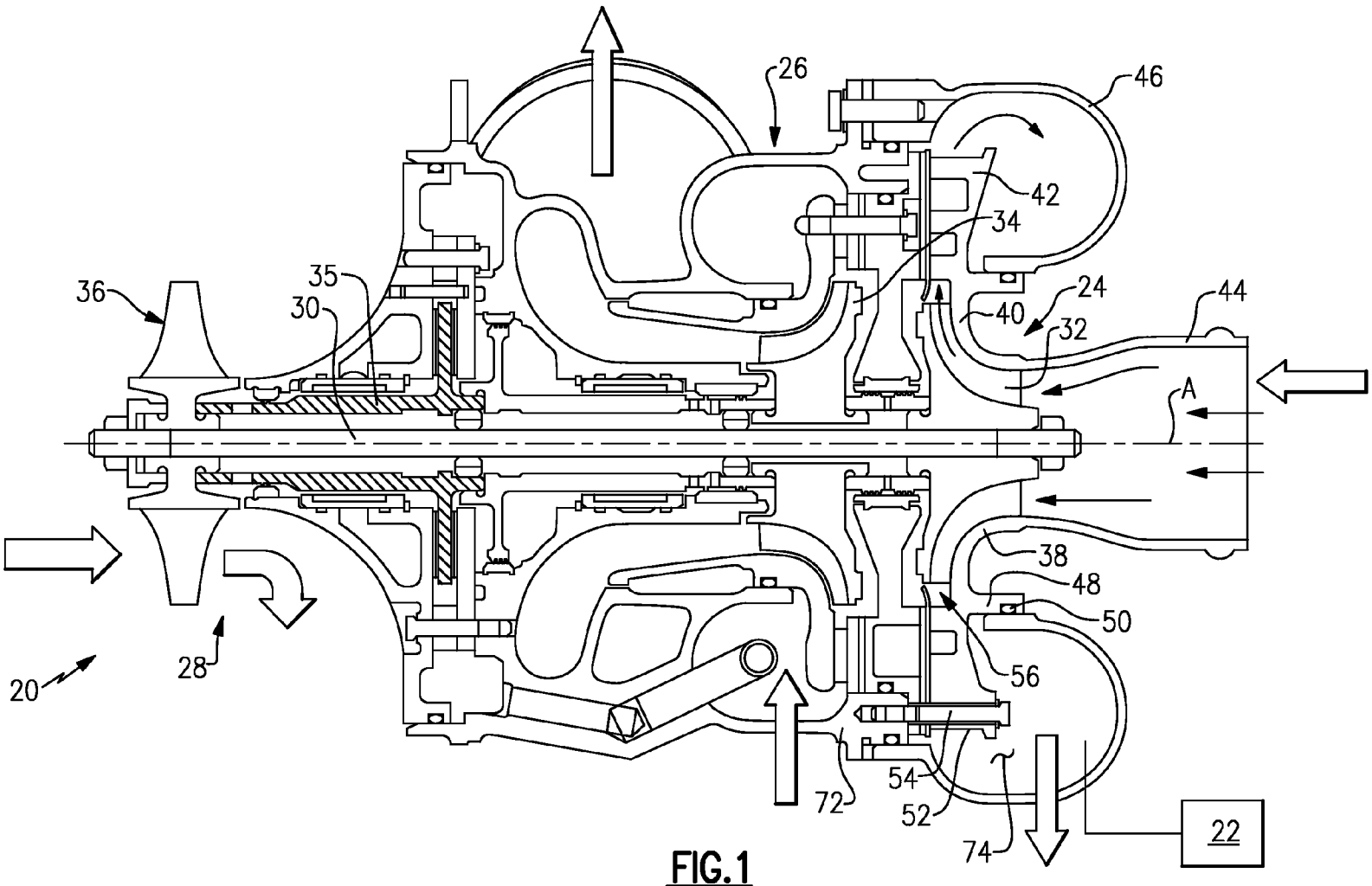
FIG. 1 is a schematic view of an example air cycle machine.

FIG. 1 shows an example air cycle machine 20 ("ACM") that is incorporated into an air supply system 22 of a vehicle, such as an aircraft, helicopter, or land-based vehicle. The ACM 20 includes a compressor section 24, a turbine section 26 and a fan section 28 that are generally disposed about a main shaft 30 and thrust shaft 35, such as a tie rod. The compressor section 24 includes a compressor rotor 32, the turbine section 26 includes a turbine rotor 34, and the fan section 28 includes a fan rotor 36. The compressor rotor 32, turbine rotor 34, and fan rotor 36 are secured on the main shaft 30 for co-rotation about an axis A.

Figure 3:
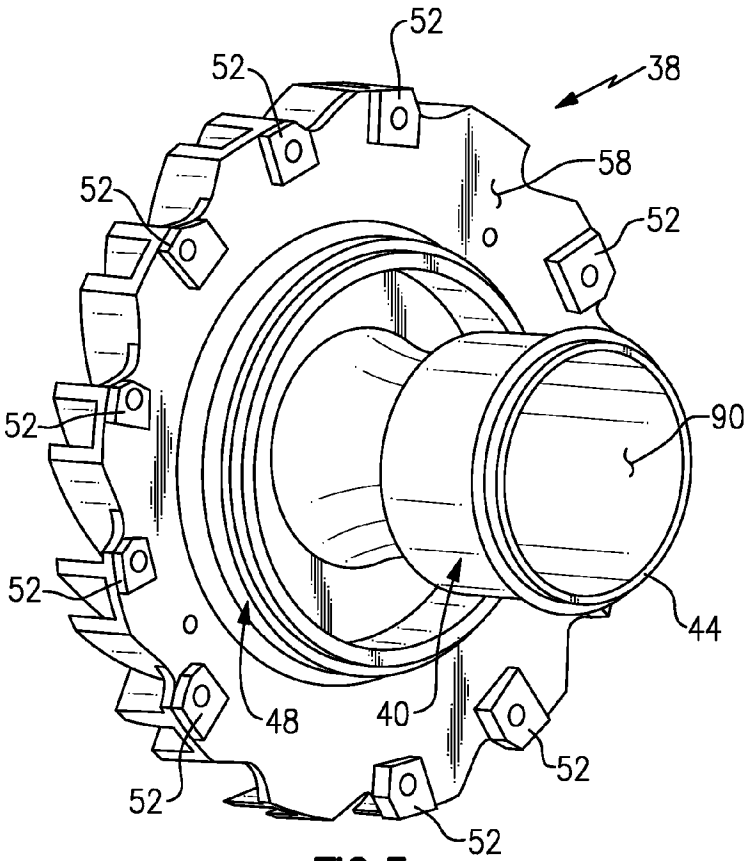
FIG. 3 is a rear perspective view of the example compressor diffuser.
Figure 2:
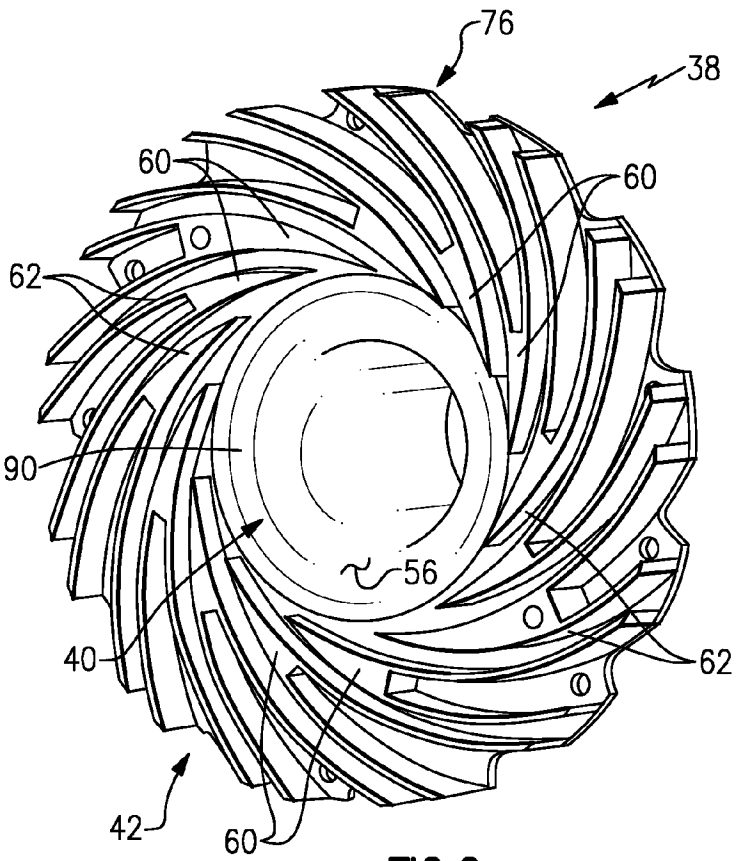
FIG. 2 is a front perspective view of an example compressor diffuser.

Referring to FIGS. 2 and 3 with continued reference to FIG. 1, the compressor section 24 includes a diffuser 38 for directing airflow exiting the compressor rotor 32. The example diffuser 38 includes a diffuser portion 42 that is substantially disk shaped and that extends radially about the axis A. The diffuser 38 also includes a hub portion 40 that is disposed about the axis A and radially inward of the diffuser portion 42. The hub portion 40 defines an inlet 44 for incoming airflow to the compressor rotor 32. The hub portion 40 and the diffuser portion 42 are a single unitary part with a continuous inner surface 90 that defines a portion of the air flow path entering the compressor rotor 32, flowing through the compressor rotor 32 and exiting the compressor rotor 32 through the diffuser portion 42 into a compressor housing 46.

The compressor housing 46 defines an airflow path exiting the ACM 20 that is directed to the air supply 22 or other device. The diffuser 38 includes a back side 58 with a plurality of boss pads 52 (FIG. 7) that define openings for fasteners 54. The fasteners 54 secure the diffuser 38 to a turbine housing portion 72. The back side 58 also includes a seal land 48 that supports a seal 50. The seal land 48 and seal 50 contacts a surface of the compressor housing 46 to provide a desired airtight airflow channel. The seal land 48 is an integral part of the diffuser 38.

The hub portion 40 defines an open annular space 56 that is surrounded by a plurality of vanes 60. The vanes 60 are arranged radially outward of the annular space 56 for the compressor rotor 32. The vanes 60 are formed to provide a desired airflow direction, pressure and character into air passage 74 defined by the compressor section 46. The vanes 60 define air passages 62 that extend radially outward from the space for the annular space 56 for the compressor rotor 32 out to an outer periphery 76 of the diffuser 38.

Figure 4:
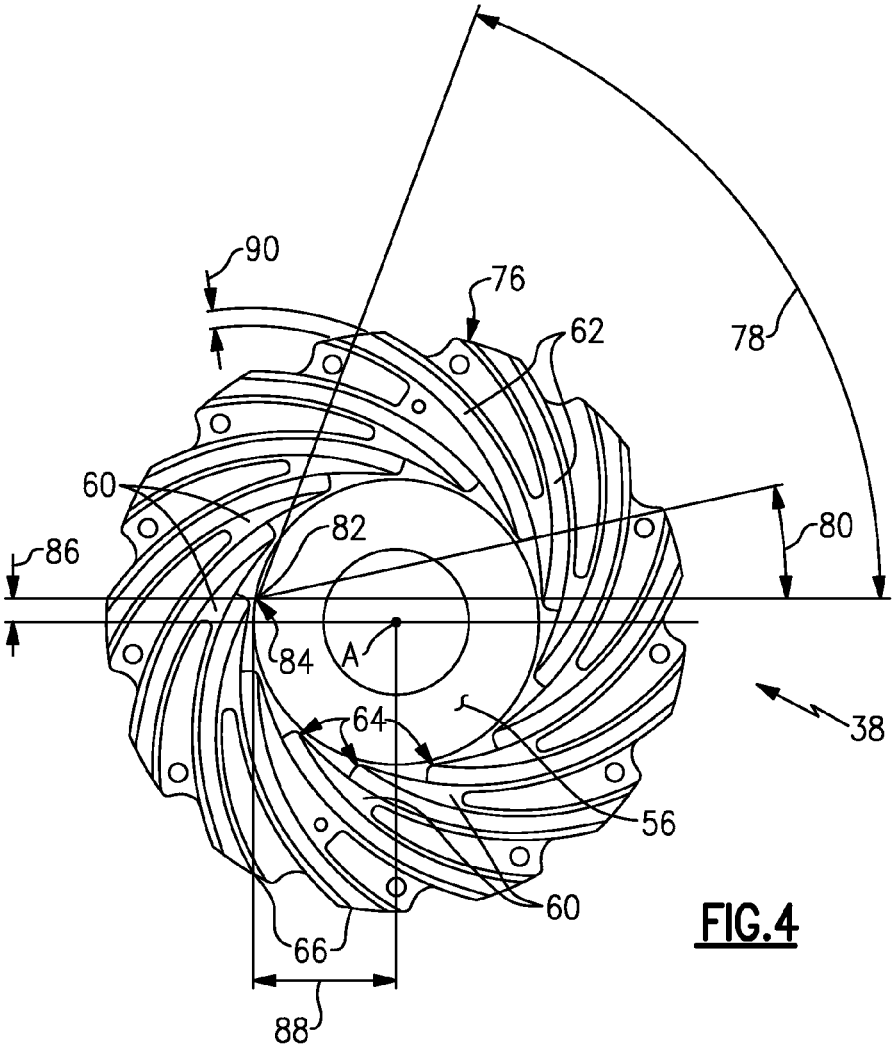
FIG. 4 is a plan view of example vanes of the example compressor diffuser.
Figure 5:
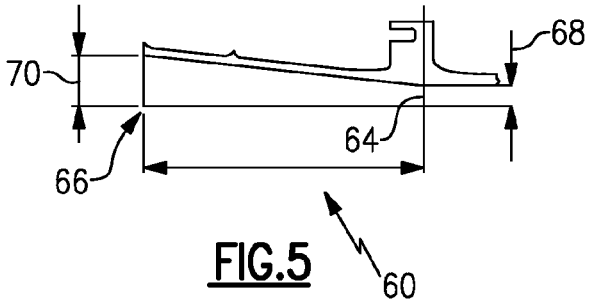
FIG. 5 is side sectional view of an example vane of the example compressor diffuser.

Referring to FIGS. 4 and 5 with continued reference to FIGS. 2 and 3, the diffuser 38 includes the plurality of vanes 60 that define the desired airflow passages 62. Each of the vanes 60 begin at a radially innermost point 64 and extend radially outward to a radially outermost point 66. Between the radially innermost and outermost points 64, 66, the air passages 62 are curved radially such that each of the passages are defined about a radius 82. The curved radially air passages 62 are provided by a varying width of each of the vanes 60. Each of the vanes 60 increases in width in a direction radially outward from the axis A. The example radius 82 is relative to a point defined on the diffuser 38 that is spaced apart from the axis A. In the illustrated example the radius is defined from a point 84 spaced above the axis A (as pictured in FIG. 4) a length 86 disposed on a side of the axis opposite the air passage 62. In this example, the point 84 is disposed at 0.223 inches (0.57 cm) above or offset from the axis A. The point 84 is offset from the axis a length 88 on a side of the axis A opposite the passage 32 that it defines. In this example the length 88 is 1.357 inches (3.45 cm). The radius from the point 84 that defines the centerline of one of the air passages 62 defined between the plurality of vanes 60. In this example, the radius 82 is 2.668 inches (6.78 cm). Each of the air passages 62 define such a radially shaped passage that extends from the open annular space 56 for the compressor rotor 32 to the outer periphery 76.

A width 90 of each of the air passages 62 remains substantially constant along the entire radial length of each air passage 62. The radial length is defined as that length that extends between the angle 80 that defines a starting point of each of the vanes 60 and the angle 78 that defines the end point of each of the vanes 60. Each of the angles 80 and 78 are relative to a plane extending parallel to the axis A from the point 84. As appreciated, each of the plurality of air passages 62 include the substantially same radial length at the same radius 82. However, each of the vanes are defined relative to a different point 84 such that each of the air passages 62 provide a substantially common and identical effects on the air flow received from the compressor rotor 32.

Referring to FIG. 5 with continued reference to FIG. 4, each of the plurality of vanes 60 vary in height between the innermost and outermost points 64, 66. FIG. 5 is an illustration of one of the plurality of vanes taken along the radial section Y and illustrates a first height 68 at the innermost point 64 and a second height 70 disposed at the outermost point of the vane 60. The first height 68 is smaller than the second height 70 to provide a desired change in flow area through the air passage 62 that provides the desired character of airflow exiting the diffuser portion 42 into the air passage 74.

In this example the first height is 0.350 inches (0.89 cm) and the second height is 0.499 inches (1.27 cm) and a ratio of the second height 70 to the first height 68 is 1.42. As appreciated each height 68, 70 is provided with certain tolerances that account for differences in manufacturing capabilities while still providing the desired air passage configuration. Accordingly the example ratio of the second height 70 to the first height 68 is between 1.48 and 1.37. The ratio between the beginning and end of each of the radial air passages 62 can be scaled as required to accommodate ACM of differing sizes and configurations.

Figure 6:
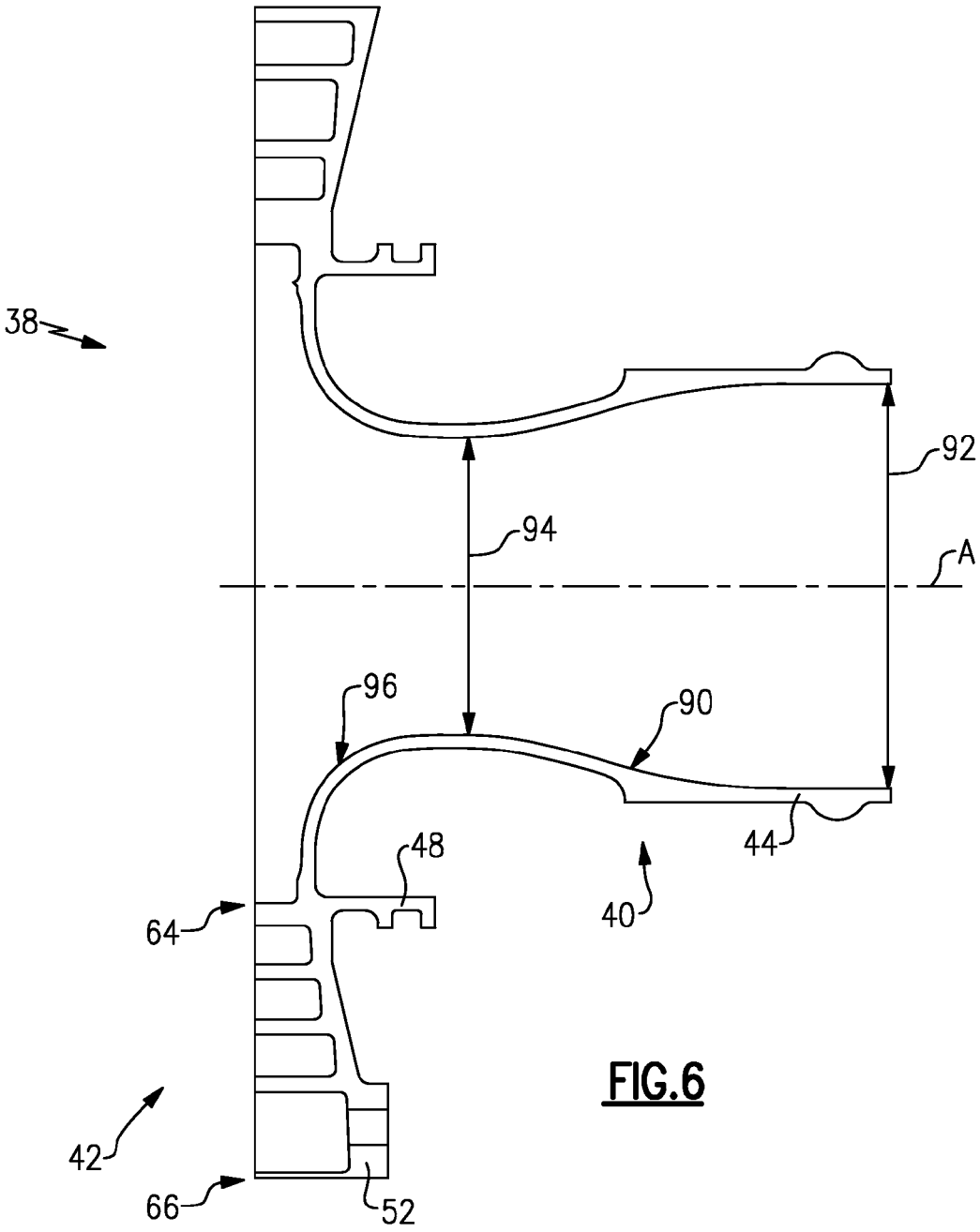
FIG. 6 is a cross-sectional view of the example compressor diffuser.
Figure 7:
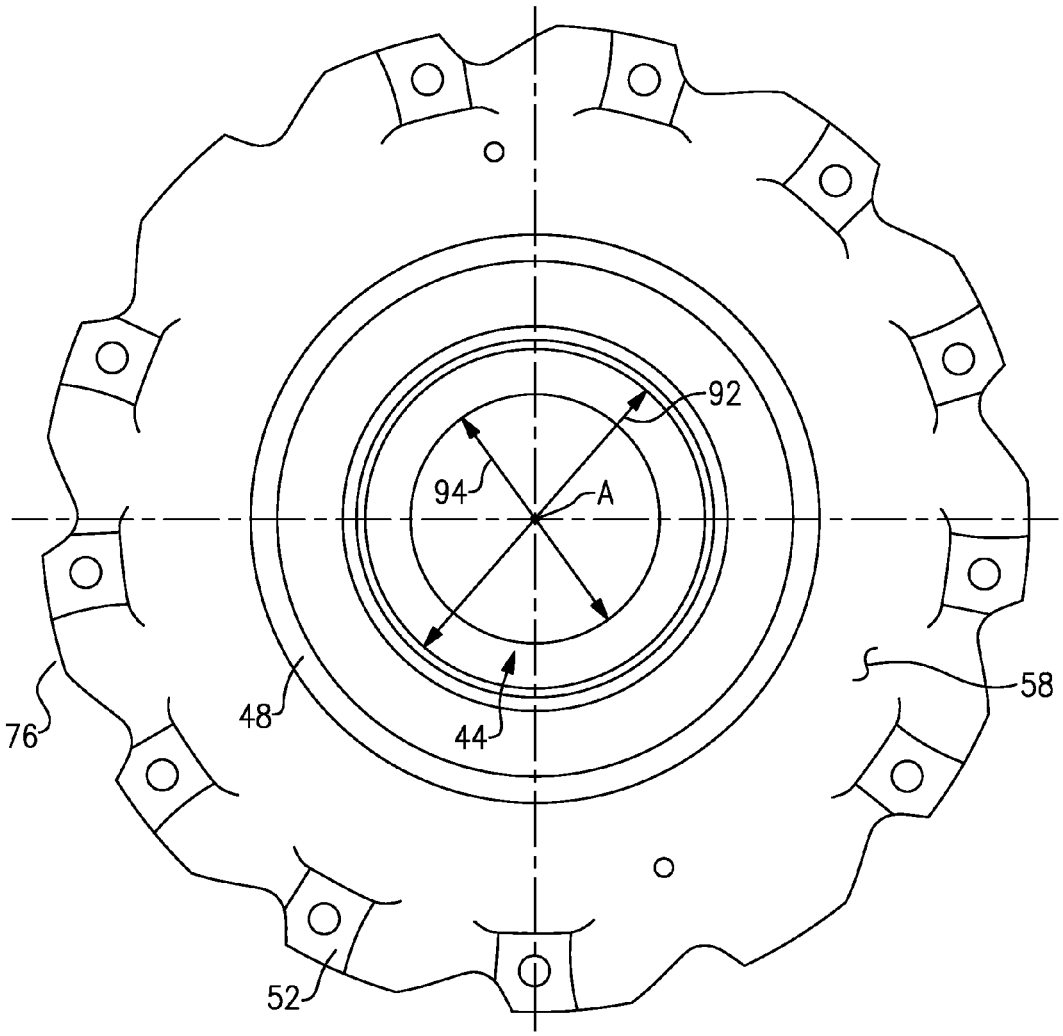
FIG. 7 is a plane view of an example inlet of the example compressor diffuser.

Referring to FIGS. 6 and 7, the example diffuser 38 not only defines the outgoing airflow from the compressor rotor 32, but also defines the inlet 44 to the compressor rotor 32. The inlet 44 is part of the hub portion 40 that is disposed about the axis A and includes an interior surface 90 presents airflow to the compressor rotor 32. The inlet 44 includes a first diameter 92 at the open end of the inlet 44. From the first diameter 92, the interior surface 90 gradually slopes radially inwardly toward the axis A to a second diameter 94 that is smaller than the first diameter 92. The decrease in diameter between the first diameter 92 and the second diameter 94 provides a corresponding decrease in area for air flow. In this example the first diameter is 1.9155 inches (4.87 cm) and the second diameter is 1.3826 inches (3.51 cm) such that a ratio of the first diameter to the second diameter is 1.385. As appreciated, tolerances are utilized to accommodate manufacturing capabilities and therefore the ratio of the first diameter 92 to the second diameter 94 is between 1.304 and 1.395. The ratio between the first and second diameters 92, 94 holds for diffusers 38 that are scaled up or down in size to accommodate different configurations of ACM 20.

The interior surface 90 further includes the contoured portion 96 that is curves radially outward in a direction axially away from the opening of the inlet 44. The contoured portion 96 is configured to correspond with a defined shape of the compressor rotor 32 to further facilitate and define a desired airflow character entering the compressor section 24.

The example diffuser 38 defines airflow both to the compressor rotor 32 from the inlet 44 and from the compressor rotor 32 through the plurality of vanes 60 that define the desired airflow passages 62. The size and shape of both the interior surface 90 of the inlet 44 and the plurality of vanes 60 of the diffuser portion 42 define and tailor the character of airflow presented to and leaving the compressor rotor 32 to provide a desired change in air pressure and flow profiles.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A compressor diffuser comprising:

a hub defining an inlet for airflow disposed about an axis;

a diffuser portion extending radially outward from the hub portion, the diffuser portion including a plurality of vanes defining curved radial passages for communicating airflow radially outward, each of the plurality of vanes including a first height at a radially innermost portion of each of the plurality of vanes and a second height at a radially outermost portion of each of the plurality of vanes, with a ratio of the second height to the first height between 1.37 and 1.48, wherein the diffuser portion defines a back side opposite the plurality of vanes, the back side including a plurality of boss pads spaced circumferentially about a periphery of the diffuser portion.

2. The compressor diffuser as recited in claim 1, wherein each of the plurality of vanes includes a width transverse to the axis, the width of each of the plurality of vanes increasing in a direction radially outward.

3. The compressor diffuser as recited in claim 2, wherein the radial passages comprise a common width beginning at the radially innermost portion to the radially outermost portion.

4. The compressor diffuser as recited in claim 1, wherein the innermost portion of each of the plurality of vanes is spaced a radial distance away from the axis.

5. The compressor diffuser as recited in claim 1, including a seal land extending axially from the back side for sealing against a portion of a compressor housing.

6. The compressor diffuser as recited in claim 1, wherein the inlet comprises a cylindrical portion extending axially opposite the diffuser portion that includes a first diameter at an inlet and a second diameter smaller than the first diameter, where a ratio of the first diameter to the second diameter is between 1.304 and 1.395.

7. The compressor diffuser as recited in claim 1, wherein each of the plurality of vanes define a continuously curved radial passage over a radial length that extends between a start angle and an end angle.

8. The compressor diffuser as recited in claim 7, wherein each of the continuously curved radial passages are of a common radial length and begin at one of a plurality of starting points equally spaced from the axis.

9. An air cycle machine comprising:

a main shaft having a fan, a turbine rotor and a compressor rotor mounted for rotation about an axis;

a housing supporting rotation of the main shaft; and a compressor diffuser secured to the housing about the compressor rotor and including a plurality of vanes defining curved radial passages for communicating airflow radially outward, each of the plurality of vanes including a first height at a radially innermost portion of each of the plurality of vanes and a second height at a radially outermost portion of each of the plurality of vanes, with a ratio of the second height to the first height between 1.37 and 1.48, wherein the compressor diffuser includes a sealing land that extends axially rearward for sealing with a portion of a compressor housing.

10. The air cycle machine as recited in claim 9, wherein a radially innermost portion of each of the plurality of vanes define an open space about the axis and the compressor rotor is at least partially disposed within the radial space.

11. The air cycle machine as recited in claim 9, wherein the compressor diffuser defines a cylindrical inlet portion extending axially opposite the diffuser portion that includes a first diameter at an inlet and a second diameter smaller than the first diameter, where a ratio of the first diameter to the second diameter is between 1.304 and 1.395.

12. The air cycle machine as recited in claim 9, wherein the compressor diffuser includes a hub portion and a diffuser portion extending radially outward from the hub portion, the diffuser portion defines a back side opposite the plurality of vanes, the back side including a plurality of boss pads spaced circumferentially about a periphery of the diffuser portion and fastener extends through each of the boss pads for securing the compressor diffuser to the housing.

13. The air cycle machine as recited in claim 9, wherein each of the plurality of vanes define a continuously curved radial passage over a radial length that extends between a start angle at the radially innermost portion of each of the plurality of vanes and an end angle at the radially outermost portion of each of the plurality of vanes.

14. The air cycle machine as recited in claim 13, wherein each of the continuously curved radial passages are of a common radial length and begin at one of a plurality of starting points equally spaced from the axis.

15. The method of installing a compressor diffuser into an air cycle machine, the method including:

extending a main shaft through a bore of a thrust shaft supported within a housing;

mounting a fan rotor, turbine rotor and compressor rotor to the main shaft for rotation about an axis with the thrust shaft;

mounting a compressor diffuser about the axis and a periphery of the compressor rotor, wherein the compressor diffuser includes a back side opposite the plurality of vanes, the back side including a plurality of boss pads spaced circumferential about a periphery of the diffuser portion and the compressor diffuser is mounted to the housing by fasteners extending through each of the boss pads; and defining a plurality of curved radial passages for communicating airflow radially outward from the compressor rotor with a plurality of vanes of the compressor diffuser, wherein each of the plurality of vanes include a first height at a radially innermost portion of each of the plurality of vanes and a second height at a radially outermost portion of each of the plurality of vanes, with a ratio of the second height to the first height between 1.37 and 1.48.

16. The method of installing a compressor diffuser for an air cycle machine as recited in claim 15, including defining an air inlet about the axis with an inlet portion of the compressor diffuser, wherein the inlet comprises a cylindrical portion extending axially opposite the diffuser portion that includes a first diameter at an inlet and a second diameter smaller than the first diameter, where a ratio of the first diameter to the second diameter is between 1.304 and 1.395.

17. The method of installing a compressor diffuser into an air cycle machine as recited in claim 15, including defining a continuous curved radial length of each of the plurality of curved radial passages between a start angle and an end angle.

* * * * *